US009556618B2

(12) United States Patent
Streicher et al.

(10) Patent No.: US 9,556,618 B2
(45) Date of Patent: Jan. 31, 2017

(54) PANEL WITH COMPRESSIBLE PROJECTIONS AND MASONRY WALL SYSTEM INCLUDING THE PANEL

(71) Applicant: Oldcastle Building Products Canada Inc., Saint-John (CA)

(72) Inventors: Mike Streicher, Lasalle (CA); Martine Morand, Montreal (CA); Luc Dugas, Saint-Hubert (CA); Michel Bouchard, Montreal (CA); Ricardo Borja, Montreal (CA)

(73) Assignee: Oldcastle Building Products Canada Inc. (CA)

( * ) Notice: Subject to any disclaimer, the term of this patent is extended or adjusted under 35 U.S.C. 154(b) by 0 days.

(21) Appl. No.: 14/429,993

(22) PCT Filed: Sep. 18, 2013

(86) PCT No.: PCT/CA2013/050711

§ 371 (c)(1),
(2) Date: Mar. 20, 2015

(87) PCT Pub. No.: WO2014/043805

PCT Pub. Date: Mar. 27, 2014

(65) Prior Publication Data

US 2015/0252571 A1 Sep. 10, 2015

Related U.S. Application Data

(60) Provisional application No. 61/703,389, filed on Sep. 20, 2012.

(51) Int. Cl.
*E04B 2/90* (2006.01)
*E04F 13/072* (2006.01)
(Continued)

(52) U.S. Cl.
CPC ..... *E04F 13/072* (2013.01); *E04F 13/0862* (2013.01); *E04F 13/0873* (2013.01);
(Continued)

(58) Field of Classification Search
CPC .. E04F 13/0875; E04F 13/0873; E04F 13/147; E04F 13/0862; E04F 13/14; E04F 13/185; E04F 13/0851
See application file for complete search history.

(56) References Cited

U.S. PATENT DOCUMENTS 405,800 A * 6/1889 Ransome ..... E04F 13/147 52/314
438,229 A 10/1890 Elterich
(Continued)

FOREIGN PATENT DOCUMENTS

CA 2211511 2/1988
CA 2387181 A1 11/2003
(Continued)

OTHER PUBLICATIONS

International Search Report and Written Opinion in related International Application No. PCT/CA2013/050711, dated Nov. 15, 2013, 8 pages.

*Primary Examiner* — Brian Mattei
*Assistant Examiner* — Gisele Ford
(74) *Attorney, Agent, or Firm* — Kilpatrick Townsend & Stockton LLP

(57) ABSTRACT

A wall panel, a masonry wall system, and a method are described. Masonry units are used with wall panels to make a masonry wall. The wall panel has a back face and a front face. The front face has multiple ribs which engage the masonry units, where each rib has top and bottom sides. The bottom sides of the ribs have multiple compressible projections with cavities which can be deformed so as to retain the
(Continued)

masonry unit in the panel. Each masonry unit has a body with a front face, a back face, and top and lateral faces. The back face and top lateral face form a back peripheral edge, and the top lateral face has at least one tooth for securing the masonry unit in the panel. In operation, the tooth compresses the projections of the horizontal ribs, thereby securing the masonry unit in the panel.

28 Claims, 14 Drawing Sheets

(51) Int. Cl.
*E04F 13/14* (2006.01)
*E04F 13/08* (2006.01)

(52) U.S. Cl.
CPC ..... *E04F 13/0875* (2013.01); *E04F 13/14* (2013.01); *E04F 13/147* (2013.01)

(56) References Cited

U.S. PATENT DOCUMENTS 658,868 A 10/1900 Rosenbaum
1,502,681 A 7/1924 Pommersheim
1,673,630 A 6/1928 Madge
1,704,035 A 3/1929 Cochran
1,707,347 A 4/1929 Dunbar
1,806,113 A 5/1931 Oscar
1,850,961 A 3/1932 Mortenson
1,861,359 A 5/1932 Frank
2,005,030 A 6/1935 Geisinger
2,016,918 A 10/1935 Born
2,043,706 A 6/1936 Myers
2,097,069 A 10/1937 Klages
2,135,118 A 11/1938 Stewart
2,198,466 A 4/1940 Stolze
2,832,102 A 4/1958 Joseph
2,882,713 A 4/1959 Diehl
2,924,963 A 2/1960 Taylor
2,938,376 A * 5/1960 Workman ..... E04F 13/0862 52/314
3,005,293 A 10/1961 Hunter
3,131,513 A 5/1964 Grigas
3,321,883 A 5/1967 Pascucci
3,421,278 A 1/1969 Christ-Janer
3,496,694 A 2/1970 Hicks et al.
3,596,420 A 8/1971 Ducker
3,712,825 A 1/1973 Yocum
3,908,326 A 9/1975 Francis
4,011,702 A 3/1977 Matyas
4,141,525 A 2/1979 Miller
4,238,915 A 12/1980 Yoshida et al.
4,242,299 A 12/1980 Adams
4,441,297 A 4/1984 Rijnders
4,478,021 A 10/1984 Person
4,589,241 A 5/1986 Volpenhein
4,662,140 A 5/1987 Porter et al.
4,773,201 A 9/1988 Trezza
4,809,470 A 3/1989 Bauer et al.
4,856,245 A 8/1989 Osawa
4,856,246 A 8/1989 Shimasaki
4,888,928 A 12/1989 Rea et al.
4,890,433 A 1/1990 Funaki
D306,907 S 3/1990 Trezza
4,916,875 A 4/1990 Kashiwagi
4,987,712 A 1/1991 Mancuso
5,228,937 A 7/1993 Passeno
5,277,009 A * 1/1994 Yamaguchi ..... E04F 13/0862 52/387
5,423,155 A 6/1995 Bauer
5,501,049 A 3/1996 Francis et al.
RE35,380 E 11/1996 Rea et al.
5,815,986 A 10/1998 Laska
5,815,989 A 10/1998 Bennenk et al.
5,822,937 A 10/1998 Mahony et al.
5,855,075 A 1/1999 Digiovanni
5,894,676 A 4/1999 DiGiovanni
6,098,363 A 8/2000 Yaguchi
6,108,995 A * 8/2000 Bouchard ..... E02D 29/025 52/284
6,164,037 A 12/2000 Passeno
6,226,947 B1 * 5/2001 Bado ..... E04F 13/0805 52/235
6,289,644 B1 * 9/2001 Gerhaher ..... E04F 13/0826 52/235
6,315,489 B1 11/2001 Watanabe
6,516,578 B1 * 2/2003 Hunsaker ..... E04F 13/147 52/385
6,802,165 B1 10/2004 Passeno
6,857,248 B2 2/2005 Ouellet et al.
6,990,778 B2 1/2006 Passeno
7,121,051 B2 10/2006 Hunsaker
D539,927 S 4/2007 Whitson
D578,224 S 10/2008 Lacas
D579,576 S 10/2008 Lacas
D584,834 S 1/2009 Lacas
7,658,050 B2 2/2010 Bouchard
D615,216 S 5/2010 Jacot et al.
D633,630 S 3/2011 Jacot et al.
7,918,065 B2 * 4/2011 Ito ..... E04F 13/0826 52/489.1
8,042,309 B2 10/2011 Wolf et al.
8,096,091 B2 1/2012 Cristina
8,101,113 B2 1/2012 Castonguay et al.
8,141,310 B2 3/2012 Trezza
D659,263 S 5/2012 Jacot et al.
8,322,103 B1 12/2012 Kownack
8,438,893 B2 5/2013 Durney et al.
8,621,801 B2 1/2014 Bouchard et al.
8,627,625 B2 1/2014 Bouchard et al.
8,888,067 B1 * 11/2014 Calmes ..... B28B 7/0073 249/15
8,966,844 B2 3/2015 Bouchard
8,973,327 B2 3/2015 Bouchard et al.
9,267,295 B2 * 2/2016 Mann ..... E04F 13/0816
2002/0174622 A1 * 11/2002 Ouellet ..... E04F 13/0862 52/745.06
2003/0037586 A1 2/2003 Durney et al.
2003/0121225 A1 * 7/2003 Hunsaker ..... E04F 13/147 52/314
2004/0050003 A1 * 3/2004 Passeno ..... E04F 13/14 52/384
2004/0065035 A1 * 4/2004 De Vlam ..... E04F 13/0862 52/384
2004/0206152 A1 10/2004 Durney et al.
2005/0028476 A1 * 2/2005 Bouchard ..... E04F 13/0862 52/596
2005/0064138 A1 3/2005 Durney et al.
2005/0284063 A1 12/2005 Losse
2006/0249881 A1 * 11/2006 Castonguay ..... B28B 7/24 264/297.9
2007/0193176 A1 8/2007 Bouchard et al.
2008/0155922 A1 7/2008 Wolf et al.
2008/0222986 A1 * 9/2008 Hamel ..... E04F 13/147 52/415
2009/0007515 A1 * 1/2009 Mercer ..... E04F 13/0862 52/483.1
2009/0100774 A1 * 4/2009 Fasching ..... B28B 19/0061 52/391
2009/0313919 A1 * 12/2009 Chuang ..... A47F 5/0846 52/202
2010/0107531 A1 * 5/2010 Hunsaker ..... E04F 13/147 52/314
2010/0107534 A1 * 5/2010 Scott ..... B28B 19/0061 52/389
2010/0155569 A1 * 6/2010 Walters ..... B28B 19/0061 249/16
2010/0326010 A1 * 12/2010 Bouchard ..... E04F 13/0862 52/762
2012/0000593 A1 * 1/2012 Guo ..... E04F 13/147 156/71

(56) References Cited

U.S. PATENT DOCUMENTS

| | | | | |
|---|---|---|---|---|
| 2012/0085052 | A1 | 4/2012 | Bouchard et al. | |
| 2012/0117904 | A1 | 5/2012 | Bouchard et al. | |
| 2012/0272598 | A1* | 11/2012 | Wilkie | E04F 13/0835 52/302.3 |
| 2014/0069050 | A1* | 3/2014 | Bolin | E04C 2/26 52/745.21 |
| 2014/0075873 | A1 | 3/2014 | Bouchard | |
| 2014/0165486 | A1 | 6/2014 | Bouchard et al. | |

FOREIGN PATENT DOCUMENTS

| | | | |
|---|---|---|---|
| CA | 2485870 | A1 | 11/2003 |
| CA | 2767456 | A1 | 2/2011 |
| EP | 0390547 | | 10/1990 |
| GB | 2245619 | | 1/1992 |
| GB | 2371314 | | 7/2002 |
| JP | 2001132194 | | 5/2001 |
| WO | 9305251 | | 3/1993 |
| WO | 9922091 | | 5/1999 |
| WO | 2009094778 | | 8/2009 |
| WO | 2010085894 | | 8/2010 |
| WO | 2011011891 | | 2/2011 |

* cited by examiner

PANEL WITH COMPRESSIBLE PROJECTIONS AND MASONRY WALL SYSTEM INCLUDING THE PANEL

CROSS-REFERENCE TO RELATED APPLICATION

This application is the U.S. national phase of International Application No. PCT/CA2013/050711 filed on Sep. 18, 2013, and published on Mar. 27, 2014 as International Publication No. WO 2014/043805 A1, which application claims priority to and the benefit of U.S. Provisional Application No. 61/703,389, filed on Sep. 20, 2012, the contents of all which are incorporated herein by reference in their entireties.

FIELD OF THE INVENTION

The present invention relates to the field of masonry works and installations. More particularly, it concerns a panel and a masonry wall system including the panel, so as to form a masonry wall with a pattern of stonework or brickwork.

BACKGROUND OF THE INVENTION

U.S. Pat. Nos. 6,857,248 and 7,658,050 in the name of the Applicant teach panels made of compressible material with depressions for receiving masonry units. The panels described in these patents include resilient projections for holding the units in place in the depressions. U.S. Pat. No. 7,658,050 also teaches a masonry unit having a tooth projection from a side or lateral face which thrusts into a corresponding compressible rib of the panel when the masonry unit is inserted into a depression. The locking interference between the compressed rib and the masonry unit holds the masonry unit in the depression until mortar can be applied, thus eliminating the need for a mixture of adhesive or cement to temporarily retain the masonry unit in the depression.

The following documents provide other examples of wall construction using panels and/or masonry units: U.S. Pat. Nos. 2,339,489; 3,238,589; 3,350,827; 3,435,577; 3,496,694; 3,521,418; 3,712,825; 3,884,737; 3,908,326; 4,433,518; 4,510,729; 4,589,241; 4,656,722; 4,858,410; 5,009,387; 5,228,937; 5,232,608; 5,232,646; 5,232,646 (re-examined); 5,386,963; 5,459,938; 5,501,049; 5,570,551; 5,632,922; 5,836,572; 5,839,251; 5,855,075; 5,894,676; 6,041,567; 6,164,037; 7,617,646; 7,871,054; US patent applications 20040065035; 20090007515; 20120085052; 20120117904 and PCT published application WO201316820.

Artificial masonry units are manufactured according to standard dimensions so as to tightly fit in a corresponding depression or channel of a panel. However, it is not uncommon to have units with dimensions varying from about +/−3 mm, and sometimes up to +/−5 mm from the standard dimensions. This situation can result from the wear of the molds used for manufacturing the units. In the case where the units are larger than the standard dimension, they tend to deform the ribs of the row, which in turn makes it difficult to install rows of units above or below the deformed row of depressions or channels. In the case where the units are smaller than the standard size, the interlocking of the units with the ribs is not sufficient enough to retain the units in the panel.

In light of the above, there is a need for panel and/or for a masonry wall system which facilitates insertion of artificial masonry units having dimensions which may vary from a standard dimension.

SUMMARY OF THE INVENTION

According to an aspect of the present invention, a wall panel for receiving masonry units is provided. Each masonry unit has a body with a front face, a back face, and top and bottom lateral faces. The back face and top lateral face form a back peripheral edge. The top lateral face is provided with at least one tooth extending at back peripheral edge. By "extending", it is meant that the tooth touches the back peripheral edge, is located near it, or spreads from it. The tooth can be recessed or indented, or it can jut or protrude from the back periphery.

The panel has a back face for covering a building surface and a front face provided with opposed ribs. Each rib has top and bottom sides. The opposed ribs are configured for receiving masonry units therebetween. The top sides of the ribs are configured to support the bottom faces of the masonry units, and the bottom sides of the ribs are configured to cooperate with the respective teeth of the masonry units so as to retain the masonry units within the panel. Each rib has compressible projections projecting from the bottom side of the rib, and each projection has a cavity therein, the cavity providing resiliency to the projection.

In some embodiments, each projection has at least one lower segment defining the cavity.

In some embodiments, said at least one lower segment defines a projection tip.

In some embodiments, said at least one lower segment has an outer contour slope different than 0.

In some embodiments, said at least one lower segment includes two angled segments meeting to form the projection tip.

In some embodiments, each projection has a top segment with a flat upper surface, the cavity being bordered by said top segment and said at least one lower segment.

In some embodiments, each projection has a thickness, the cavity extending through said thickness and opening on an exposed side of the rib.

In some embodiments, for each projection, the cavity has a shape similar to a shape of the projection.

In some embodiments, each projection has an upper end and a lower end and a height which spans from the upper end to the lower end.

In some embodiments, said lower end is narrower than said upper end.

In some embodiments, at least some of said compressible projections are semi-circular.

In some embodiments, at least some of said compressible projections are triangular.

In some embodiments, the opposed ribs are parallel and extend horizontally along the front face of the panel.

In some embodiments, the projections include at least two different sets of projections, each set having projections of the same height, and wherein the height of the projections is different for each set.

In some embodiments, the projections of at least one corresponding horizontal rib include a first set of projections having a first height H1 and a second set of projections having a second height H2, the first height H1 being greater than the second height H2, the first and second sets of projections configured for accommodating masonry units having heights varying from a standard unit height dimension.

In some embodiments, the projections of the first set are alternated with the projections of the second set on said horizontal rib.

In some embodiments, the at least one of the horizontal ribs includes several rib sections, each rib section creating a through opening in said horizontal rib, thereby allowing water to flow towards the bottom of the panel.

In some embodiments, the wall panel has depressions for receiving respective masonry units, each depression being bordered by opposed horizontal ribs, and by two vertical ribs.

In some embodiments, the depressions are of various dimensions and configured for retaining masonry units of different standard sizes.

In some embodiments, said panel is made of polystyrene, foam or any other compressible material.

According to another aspect, a masonry wall system for covering a building surface is provided. The masonry wall system includes at least one panel as defined above. It also includes masonry units sized to fit between two of said opposed ribs, each masonry unit having a body having a front face, a back face, and four lateral faces providing a thickness to the masonry unit. The back face and top lateral face form a back peripheral edge, said top lateral face being provided with at least one tooth for securing the masonry unit in the panel. Said tooth has a part which projects or is recessed from the back peripheral edge of the masonry unit, and is configured for compressing the projections of said adjacent horizontal ribs, to secure the masonry unit in the panel. Advantageously, the shape of the tooth can accommodate potential deformations of the ribs.

In some embodiments, each of the masonry units has a height, the height of some of the units differing from a standard height by a height variation.

In some embodiments, said height variation is less than 5 mm.

In some embodiments, each projection is vertically compressible by a given one of said masonry units by a distance corresponding to at least the height variation of said given masonry unit.

In some embodiments, for each of the masonry units, said at least one tooth extends continuously along said top lateral face.

In some embodiments, the masonry units are provided with teeth on their top lateral face, and also on another lateral face contiguous to said top face. This is especially advantageous for square units, since it allows positioning the unit in more than one orientation in the panel.

In embodiments where the units have projecting teeth, the masonry units have spacers for facilitating the handling of several of said masonry units in a single handling operation, each of the spacers being positioned and sized so as to fit between two projections upon the masonry unit being inserted in the panel.

In some embodiments, each of the masonry units has spacers for facilitating the handling of several of said masonry units in a single handling operation, each of said spacers being positioned and sized so as be located forward of the projections upon the masonry unit being inserted in the panel.

According to a specific and preferred embodiment of the invention, a masonry wall system for covering a building surface is provided. The system comprises a plurality of masonry units, each masonry unit comprising a body having a front face, a back face, and lateral faces including top and bottom lateral faces. The lateral faces provide a thickness to the masonry unit. The back face and top lateral face form a back peripheral edge. The top lateral face is provided with at least one tooth recessed or projecting from the back peripheral edge, for securing the masonry unit in the panel. The system also comprises at least one wall panel for receiving the masonry units. The panel has a back face for covering the building surface, and a front face provided with opposed longitudinal ribs. Each rib has top and bottom sides, opposed ribs being configured for receiving masonry units therebetween. The top sides of the ribs are configured for supporting the bottom faces of the masonry units and the bottom sides of the longitudinal ribs are configured to cooperate with the at least one tooth located on the top face of each masonry unit so as to retain the masonry unit within the panel. Each rib has compressible projections extending from its bottom side. Each projection comprises a cavity therein, the cavity providing resiliency to the projection, and a top segment with a flat upper surface for supporting the bottom face of the masonry units, and at least one lower segment. The cavity is thus bordered by the top segment and said at least one lower segment. The projections include at least two sets of projections, all projections of a set having a same height. The height of the projections is different from one set to another. The different sets of projections are sized for accommodating masonry units having heights varying from a standard unit height dimension.

According to another aspect, a method for making a masonry wall is provided. The method includes the step of providing a masonry wall system as defined above. It also includes the step of mounting side by side, on the building surface, a plurality of the at least one panel and fastening the panels to the building surface with retaining anchor screws. It also includes the step of inserting, between at least two opposed horizontal ribs, one of the masonry units and retaining said masonry unit by compressing the projections and deforming the corresponding cavities. It also includes the step of repeating step c) with all of said masonry units. It also includes the step of mortaring the masonry units and the retaining anchor screws.

With the present invention, masonry units having a height varying from about +/−5 mm, and preferably +/−3 mm, can be received between two horizontal ribs. The cavities or voids in the projections permit the projections to be compressed to a greater extent than with projections which are full.

BRIEF DESCRIPTION OF THE DRAWINGS

Other objects and advantages of the invention will become apparent upon reading the detailed description and upon referring to the drawings in which.

DETAILED DESCRIPTION OF PREFERRED EMBODIMENTS OF THE INVENTION

Figure 1:
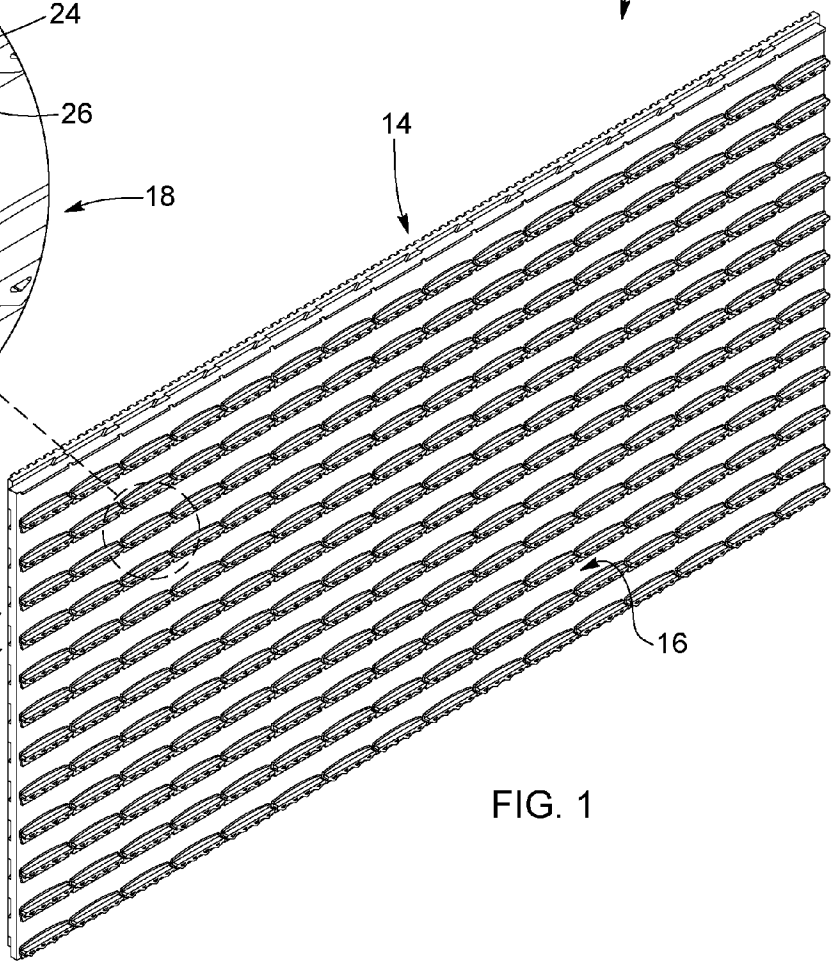
FIG. 1 is a perspective view showing a panel, according to an embodiment.

In the following description, the same numerical references refer to similar elements. Furthermore, for the sake of simplicity and clarity, namely so as to not unduly burden the figures with several references numbers, not all figures contain references to all the components and features of the present invention and references to some components and features may be found in only one figure, and components and features of the present invention illustrated in other figures can be easily inferred therefrom. The embodiments, geometrical configurations, materials mentioned and/or dimensions shown in the figures are preferred, for exemplification purposes only.

It will be appreciated that positional descriptions such as "top", "bottom", "horizontal", "vertical" and the like should, unless otherwise indicated, be taken in the context of the figures and should not be considered limiting. They are meant to refer to the usual, but not exclusive, orientation of the elements of the masonry panel and system.

Two different embodiments of a panel 12 according to the invention are shown in FIGS. 1-1A and 7-7A. Each panel 12 has a back face 14, for covering the building surface and an opposed front face 16 having multiple protruding horizontal ribs 18. The panels 12 are preferably entirely made of polystyrene, foam, or any other similar compressible material. Alternatively, only the ribs 18 can be made slightly flexible, to cooperate with teeth of masonry units in an interlocking relation. It can also be considered that only the projections 24 be made of a compressible material.

Figure 1A:
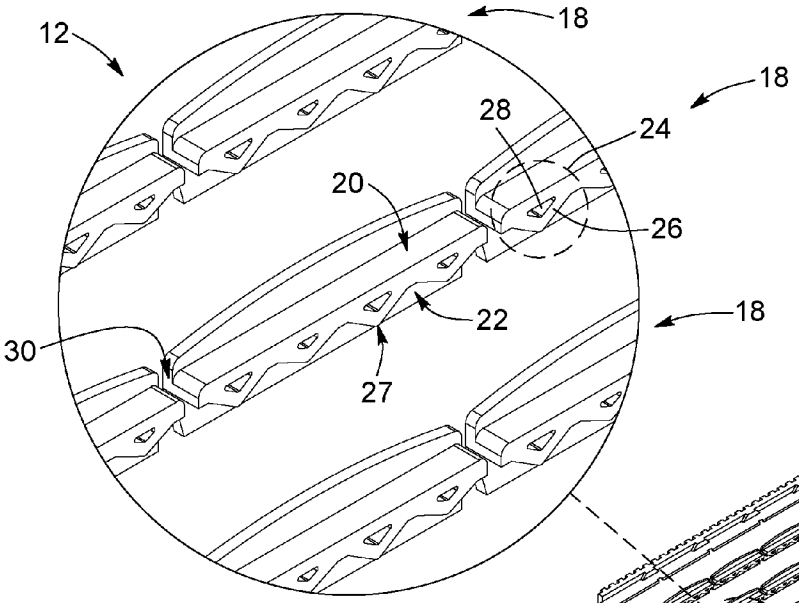
FIG. 1A is a close-up view of the panel of FIG. 1.
Figure 2:
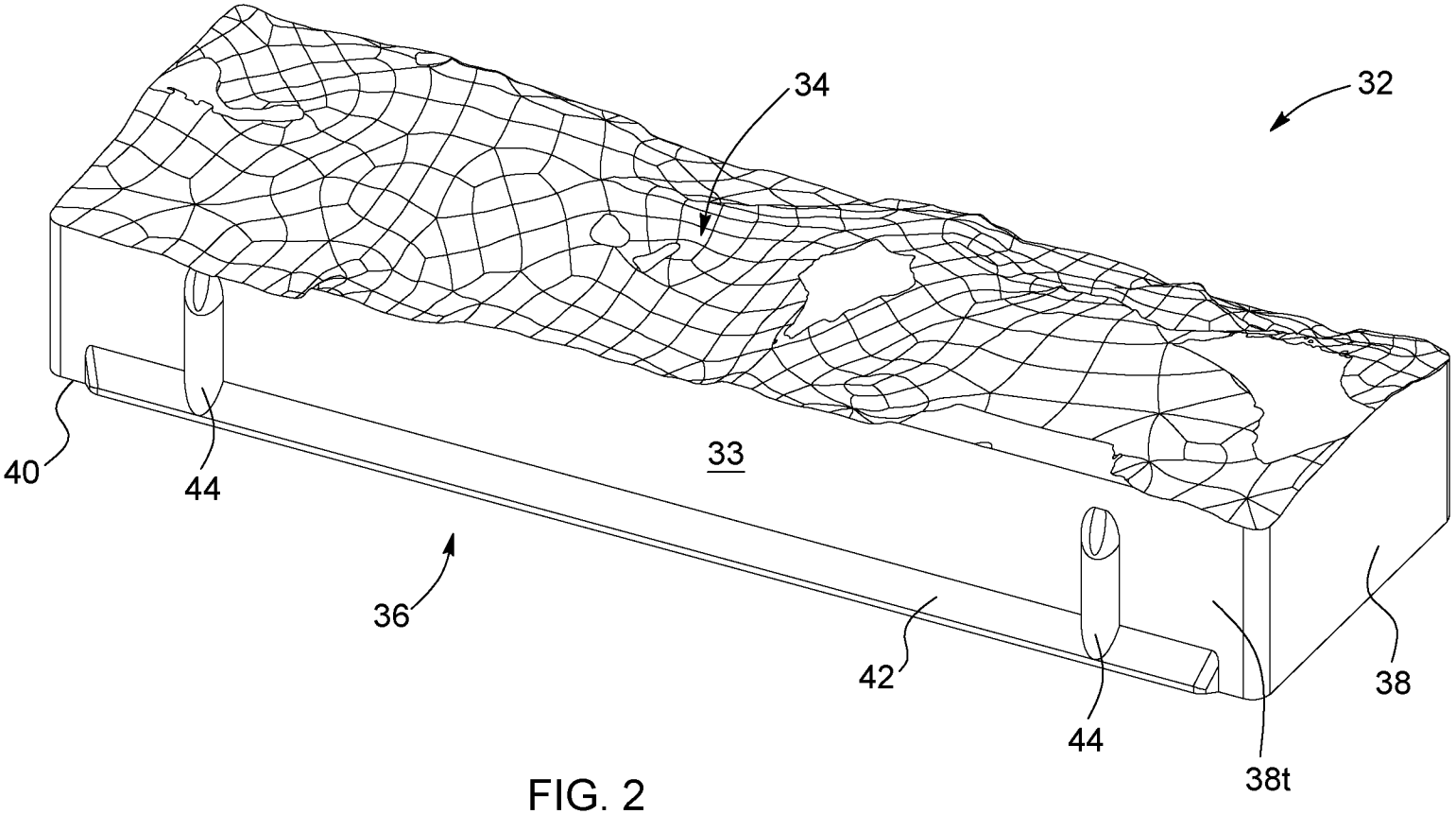
FIG. 2 is a perspective view of a masonry unit, for fitting in a panel, according to an embodiment.
Figure 7A:
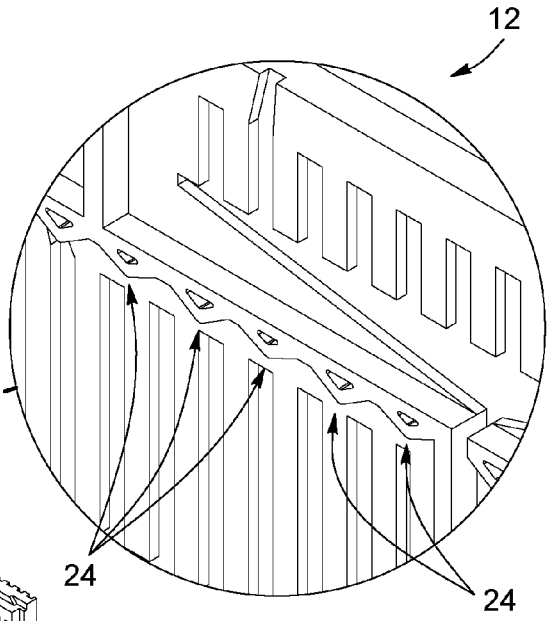
FIG. 7A is a close-up view of the panel of FIG. 7.
Figure 9A:
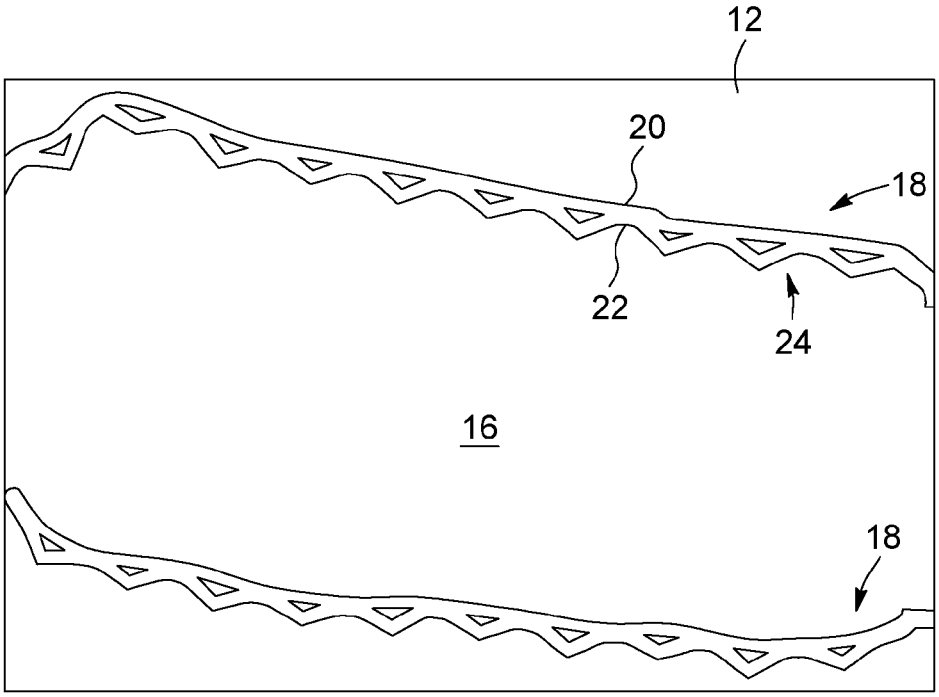
FIG. 9A is a partial front view of a panel, according to an embodiment of the invention.

Referring now to FIGS. 1A and 7A and 9A, each rib 18 has a top side 20 and an opposed bottom side 22. Together, the top and bottom sides 20, 22 of opposed ribs 18 cooperate to receive masonry units therebetween. The term "opposed" as used to characterize the relationship of adjacent ribs 18 refers to the position of the ribs 18 with respect to one another, in that one rib 18 is vertically spaced from another rib 18. In the panels 12 of FIGS. 1A and 7A, the ribs extend horizontally and in parallel along the front face 26. These variants of the panel allow receiving rectangular and square units. In the embodiment of the panel of FIG. 9A, the opposed ribs extend substantially longitudinally, but are not parallel to each other, so as to accommodate units having an irregular, or non-rectangular shape. The ribs are slightly inclined on the panel 12. The top sides 20 of each rib 18 can support the weight of the masonry units placed against them. Typically, the bottom faces of the masonry units are placed against the top sides 20 of the ribs 18. Referring to FIG. 1A, it can be seen that, in order to palliate potential water infiltration or water condensation behind the masonry units, the ribs 18 are preferably made of several rib sections 30. Each rib section 30 creates through openings in the line of the ribs 18, which allows the water to flow towards the bottom of the panel 12.

Figure 5:
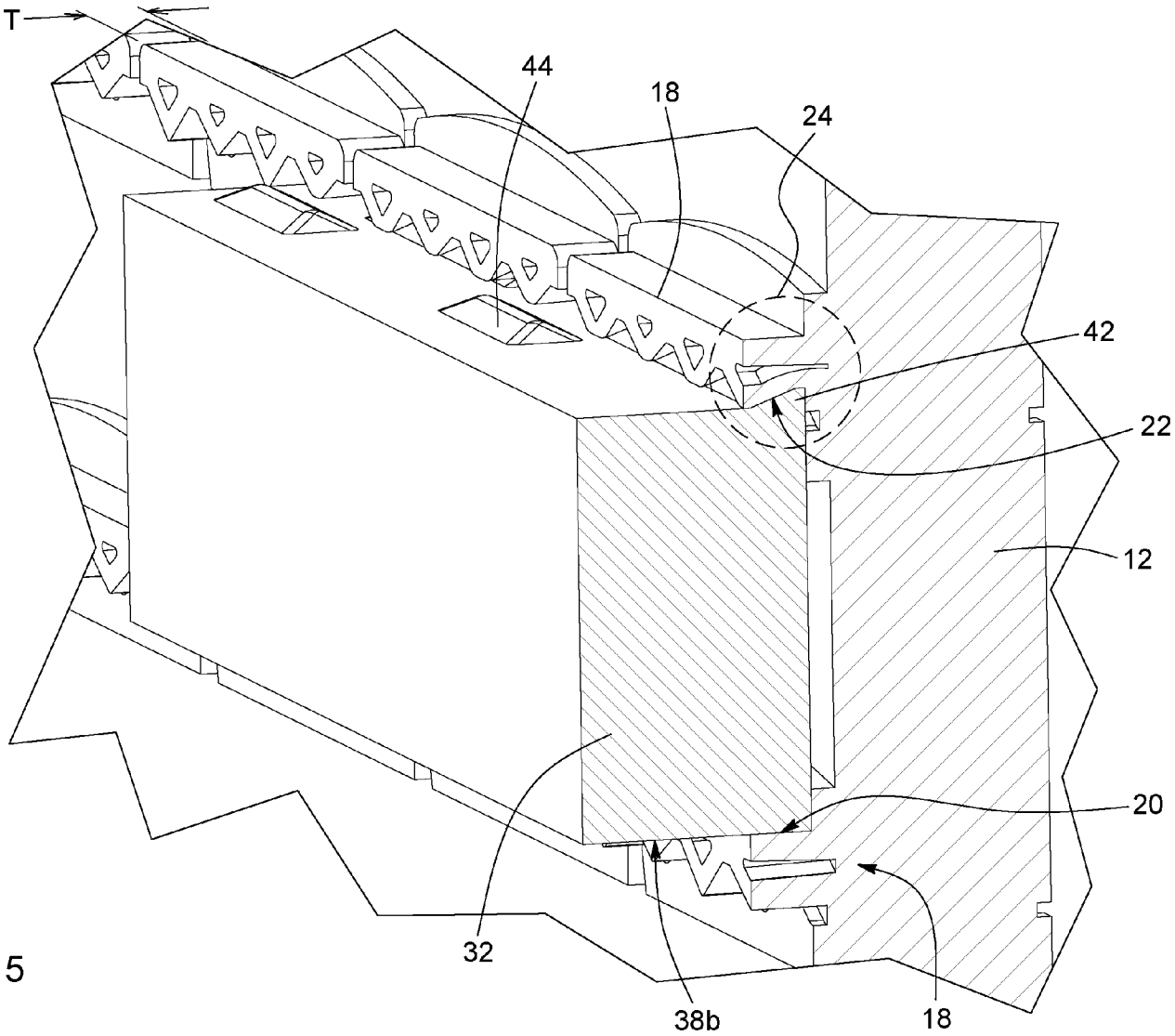
FIG. 5 is a partial cross-sectional view of the panel of FIG. 1 with the unit of FIG. 4 inserted between two horizontal ribs.
Figure 5A:
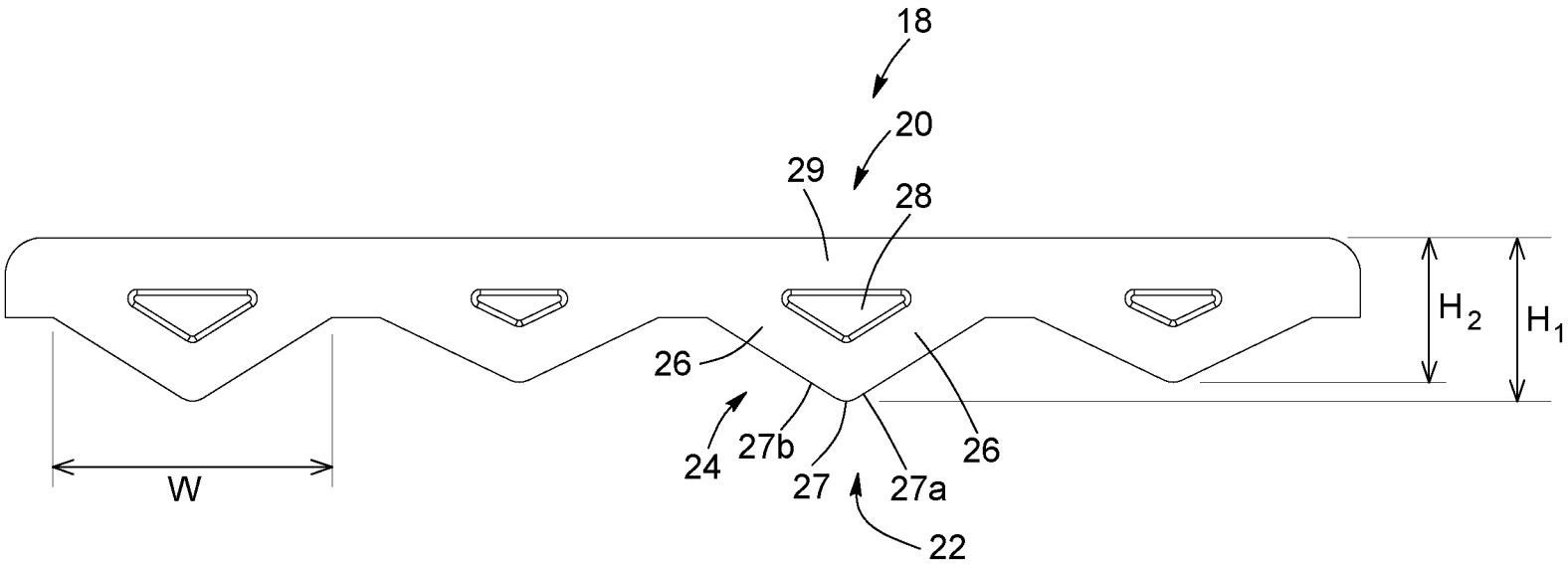
FIG. 5A is a front view of a portion of an horizontal rib of a panel, according to an embodiment.

Referring to FIG. 5A, the bottom sides 22 of each rib 18 are provided with compressible projections 24. The projections 24 can be any suitable object or mass which extends away from the bottom side 22 of the rib 18 and has the functionality ascribed to it herein. Each projection 24 has one or more cavities 28 therein. The cavities 28 may be formed by extending through a thickness T (identified on FIG. 5) of the projections 24, such that the cavities 28 open on an exposed side of the ribs 18. The cavity 28 provides resiliency to the projection 24, allowing the projection 24 to deflect or compress in response to pressure applied against it, such as by the top face of a masonry unit. The lower segment forming the projection 24 can be distorted and compressed, without deflecting the upper segment, which also corresponds to the top side of the rib. An axis of the cavity passing through it is thus perpendicular to the front face of the panel. The cavity 28 also allows the projection 24 to return to its original shape when the pressure is not applied against it. In so doing, the projections 24 help to retain the masonry units within the panel 12.

In some embodiments, each projection 24 has one or more compressible lower segments 26, and one or more top segments 29, which define the cavity 28. The term "define" refers to the ability of the lower segments 26 to affect the shape or configuration of the cavity 28, and thus the projection 24, which may have similar shapes to each other. The lower segments 26 can be integrally part of the rib 18. In the embodiment shown in FIG. 5A, the upper segments 29 and lower segments 26 structurally reinforce the rib 18, thereby increasing the load bearing capability of the rib 18.

Still referring to FIG. 5A, some or all lower segments 26 may be angled or have an outer contour with a slope that is greater or less than 0 in value. If such a lower segment 26 projects downwardly, it may define a projection 24 having a triangular shape. Such triangular projections may advantageously provide increased resiliency to the ribs 18, and also increase, or at least maintain, the structural integrity of the rib 18. Such a triangular projection 24 may have a projection tip 27, against which the top face of the masonry unit, or one of its teeth, can be applied. The projection tip 27 can be defined by the two lower portions 27*a*, 27*b* of the lower segments 26, which meet at a point defining the projection tip 27. Of course, the projections 24 can have other shapes, such as a semi-circular or an oval shape, examples of which are shown in FIGS. 10A to 100. The shape of the cavity 28 may differ from the overall shape of the projection 24. The projections 24 are spaced apart from one another, and may be disposed in series, although other configurations can also be considered.

Figure 3:
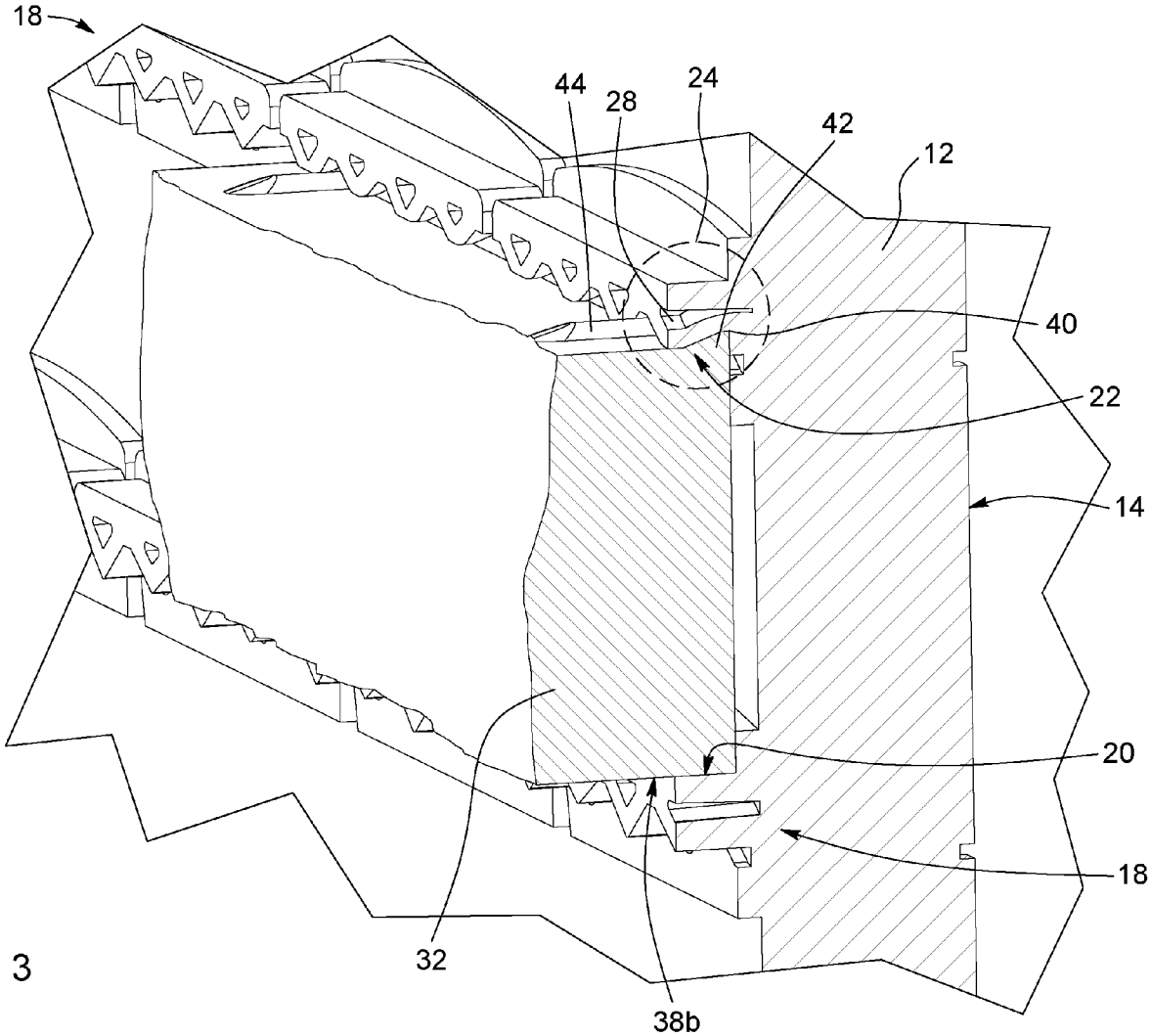
FIG. 3 is a partial cross-sectional view of the panel of FIG. 1 with the unit of FIG. 2 inserted between two horizontal ribs.

As best shown in FIGS. 1A, 3 and 5A, the projections 24 are preferably of at least two different heights $H_1$ and $H_2$, so as to accommodate masonry units of various heights, and those that vary from the standard dimensions. As can be seen from FIG. 5A, the height of each projection 24 can be measured from its lower end to its upper end. In some embodiments, the lower end of each projection 24 is narrower than the upper end. The projections 24 with the greater height, for example $H_1$, are sized to capture the masonry units of smaller dimensions. The projections 24 with the smaller height, $H_2$, are sized to capture the masonry units of larger dimensions. The projections 24 with height $H_2$ may be particularly suitable to provide a degree of compression when the projections having height $H_1$ exceed a given compression force. In other words, having projections 24 of different heights permits receiving and retaining units having respective heights which differ from a standard dimension. Indeed, this ability to retain the units may be further improved by alternating, in series, lower height projections 24 with greater height projections 24, or vice versa. Of course, it can be considered to have projections with three or more different heights, in other versions the panel.

Figure 7:
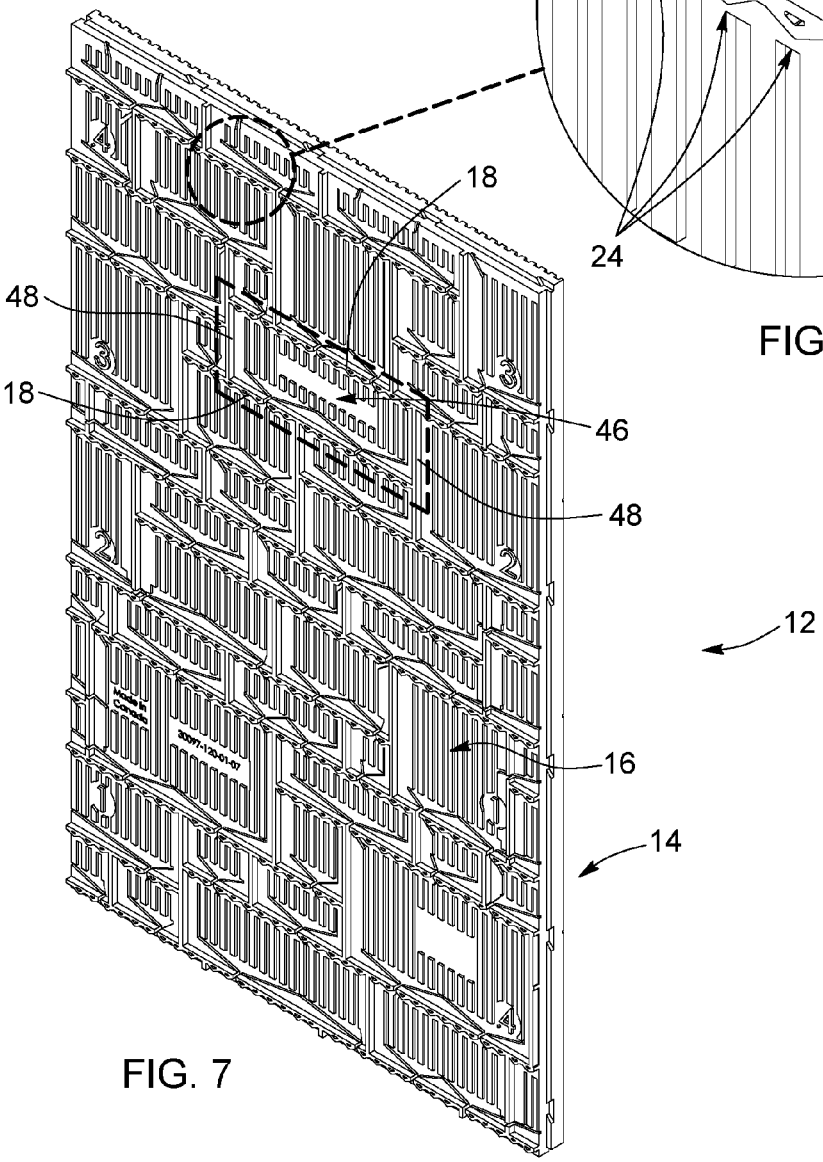
FIG. 7 is a perspective view showing a panel, according to yet another embodiment.

In some embodiments, examples of which are provided in FIGS. 7-7A, the panel 12 includes depressions 46 for receiving the respective masonry units. Each depression 46 is bordered by opposed horizontal ribs 18, and also by two vertical ribs 48. In the panel 12 shown in FIGS. 7-7A, the depressions 46 can be of various dimensions, in order to accommodate and retain masonry units of different sizes. Of course, the depressions 46 can also have all the same dimensions, for example for forming a masonry wall with rectangular bricks having all the same size. A predetermined pattern of depressions 46 can be made in the front face 16 of the panel 12 in a staggered fashion, to provide a masonry wall that looks like stonework. Preferably, the depressions 46 are pre-cut in the panel 12, or pre-moulded, as the panel 12 is being moulded. It can thus be appreciated that the depressions 46 advantageously facilitate the placement of the units in the panel 12.

Turning now to FIGS. 2, 4-4A, 6-6A, 8 and 9, different possible embodiments of masonry units 32 are shown. The units 32 are preferably pre-cast concrete simile-stones having predetermined shapes and sizes, such as bricks or other stone types. It will be appreciated that other materials may be used to make the units 32. The masonry units 32 are sized to fit between two horizontal ribs 18 of the panel 12 described above.

Still referring to FIGS. 2, 4-4A, 6-6A, 8-8A and 9, each unit 32 has a body 33 bounded by a front face 34, a back face 36 and lateral faces 38, the four lateral faces 38 providing thickness to the unit 32. The back face 36 and the top lateral faces 38*t* form a back peripheral edge 40. The front face 34 is the face that is still exposed to viewers of the masonry unit 32 one it has been inserted in a panel 12.

The front face 34 can be irregular or not. If irregular, it can have a non-uniform color or texture or profile, or a combination of these characteristics. The top lateral face 38*t* is provided with at least one tooth 42. By top lateral face 38*t*, it is meant the lateral face that faces upwardly when the unit 32 is inserted in a panel 12. The tooth 42 helps to secure the unit 32 in the panel 12. The tooth 42 has a part projecting from the back peripheral edge 40 of the unit 32. The tooth 42 helps to secure and retain the unit 32 in the panel 12 by compressing the projections 24 of the ribs 18 of the panel 12. In most embodiments, but not necessarily all, the tooth 42 compresses the bottom surface 22 of the top ribs 18, when placed in the panel 12. It can thus be appreciated that the tooth 42 advantageously helps to reduce the need to use a mixture of cement on the back face 36 of the unit 32 to temporarily retain the masonry units 32 within the panel 12.

Figures 4, 4A:
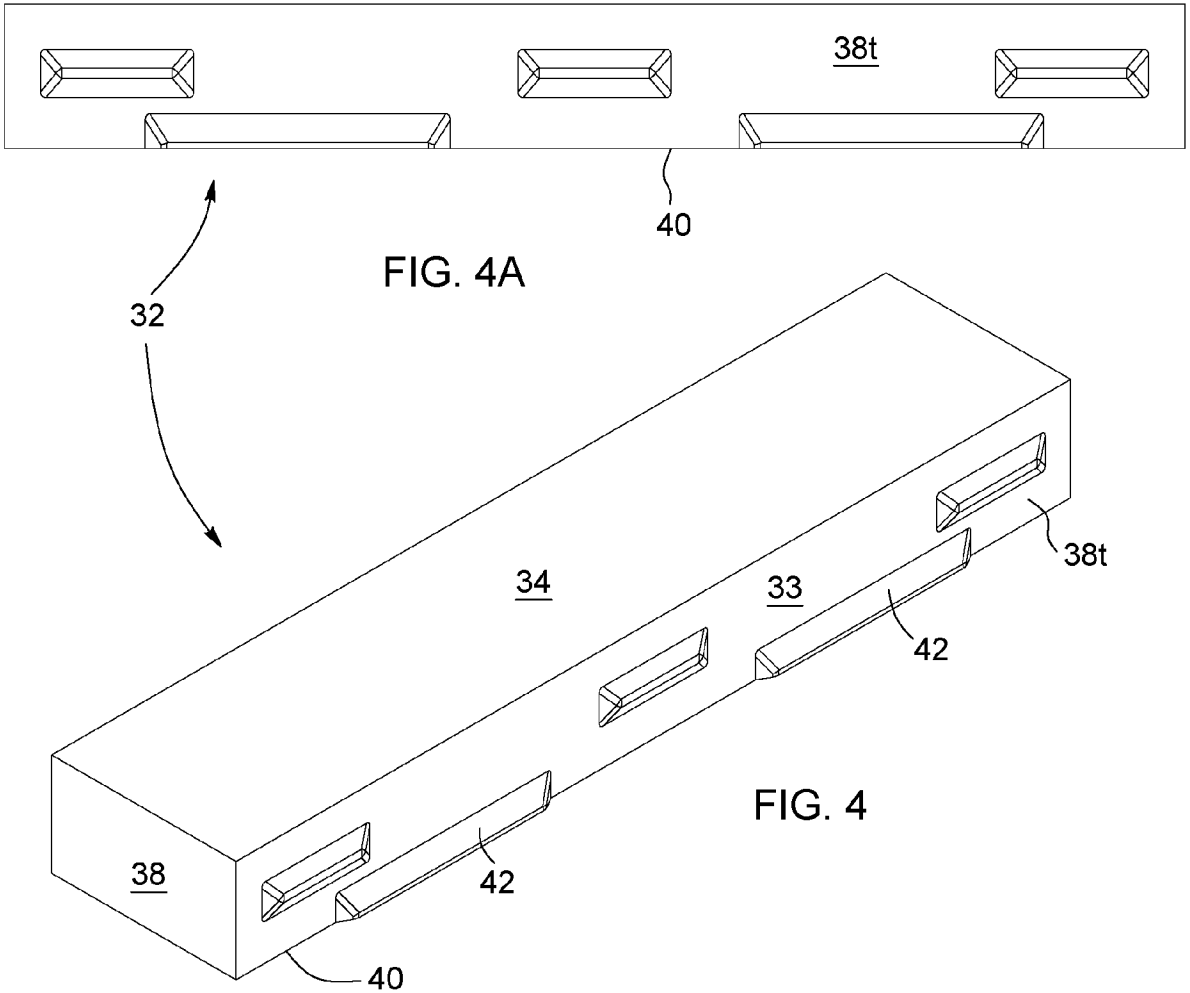
FIG. 4 is a perspective view of a masonry unit, for fitting in a panel, according to another embodiment.
FIG. 4A is a top view of the unit of FIG. 4.
Figure 8:
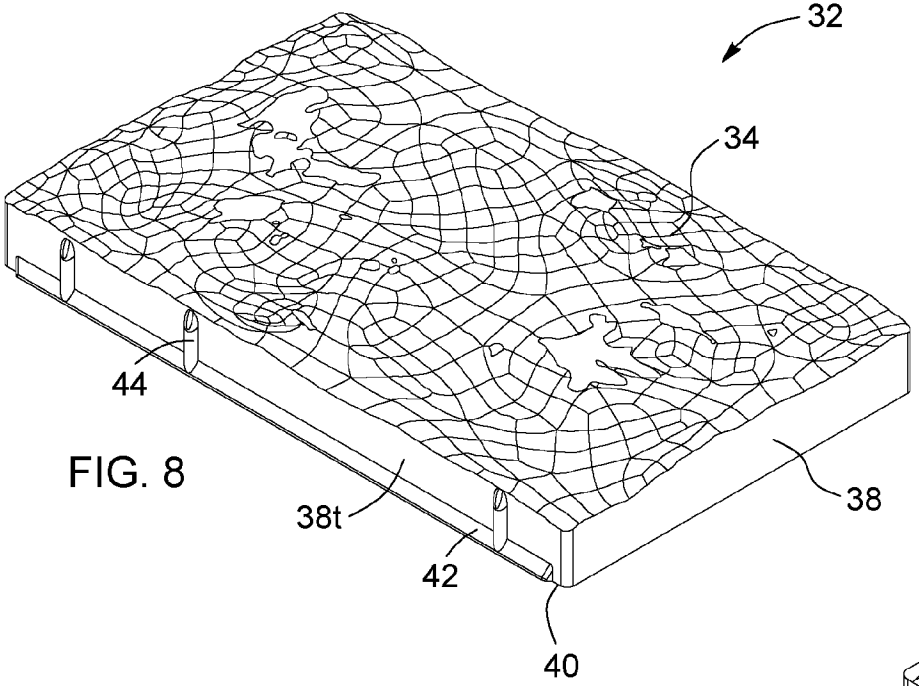
FIG. 8 is a perspective view of a rectangular masonry unit, for fitting in a panel, according to yet another embodiment.
Figure 8A:
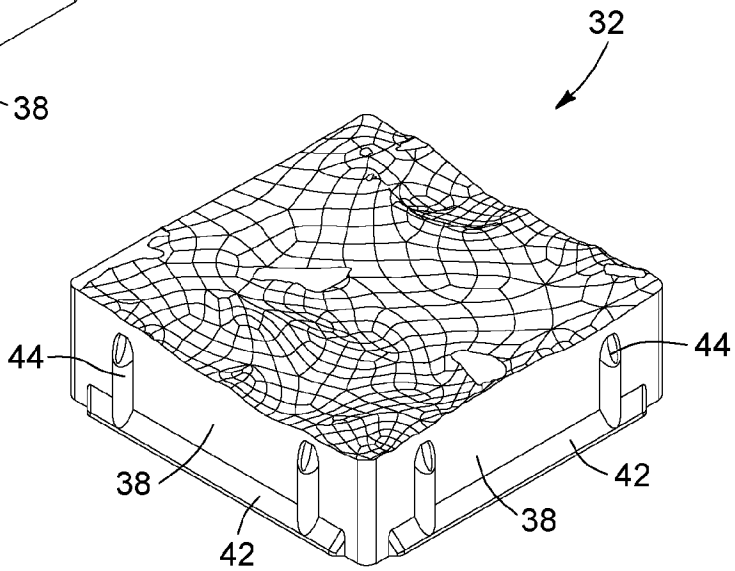
FIG. 8A is a perspective view of a square unit, according to another embodiment.

In the embodiments shown in FIGS. 2, 6-6A, 8-8A, and 9, the tooth 42 extends continuously along the top lateral face 38*t*, but the tooth 42 can include more than one tooth 42, as shown in FIGS. 4-4A. The unit 32 also has spacers 44 for facilitating the handling of several of said units 32 in a single handling operation, each of the spacers 44 being positioned and sized so as to fit between two projections 24 when the unit 32 is inserted in the panel 12, as exemplified in FIG. 3. In the embodiments shown in 2, 6-6A, 8-8A, and 9, the spacers 44 are placed transversally along the top lateral face 38*t*. The function of the spacers 44 is to facilitate the handling of the unit 32 during the manufacturing process, especially during the clamping process of the units when they are disposed on pallets. As shown in FIG. 8A, a square masonry unit 32 can be provided with a tooth 42 and spacers 44 on more than one lateral side. This allows the unit to be positioned in the panel in more than one orientation.

Now referring to FIGS. 4-4A, it can be considered to locate the spacers 44 longitudinally along the top lateral face 38*t*. In such a configuration, when the unit 32 is inserted in the panel 12, and the tooth 42 compresses the projections 24, the spacers 44 may not compress the projections 24, but are located just ahead of the projections 24, as best shown in FIG. 5.

Figure 6A:
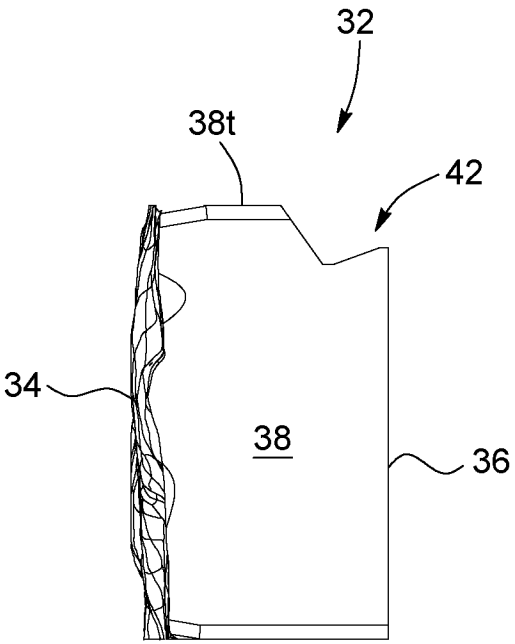
FIG. 6A is a side view of the unit of FIG. 6.
Figure 6:
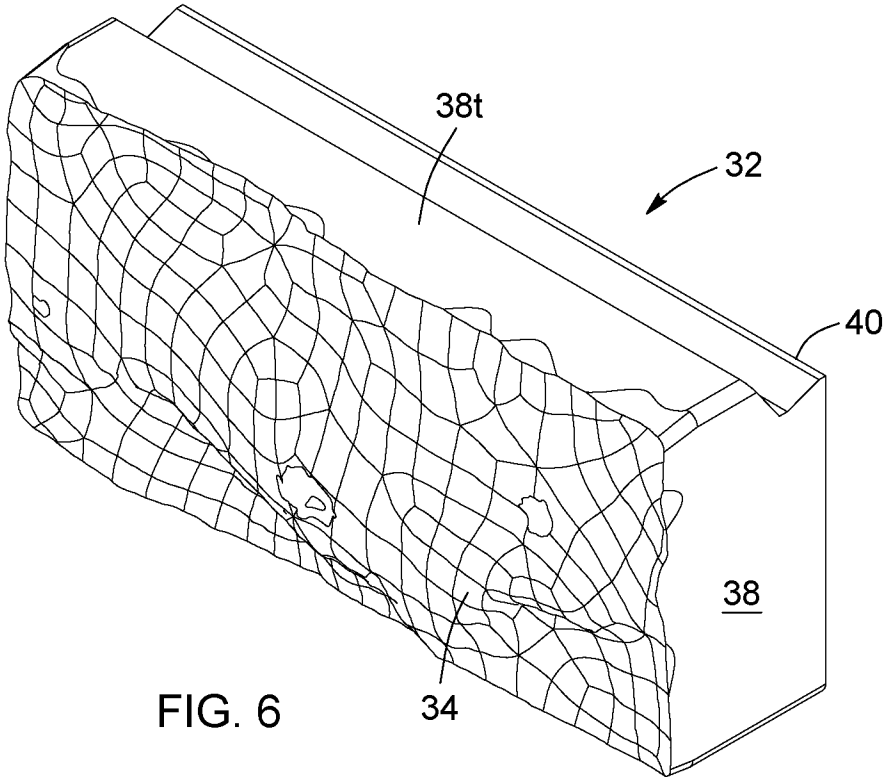
FIG. 6 is a perspective view of a masonry unit, for fitting in a panel, according to yet another embodiment.
Figure 6B:
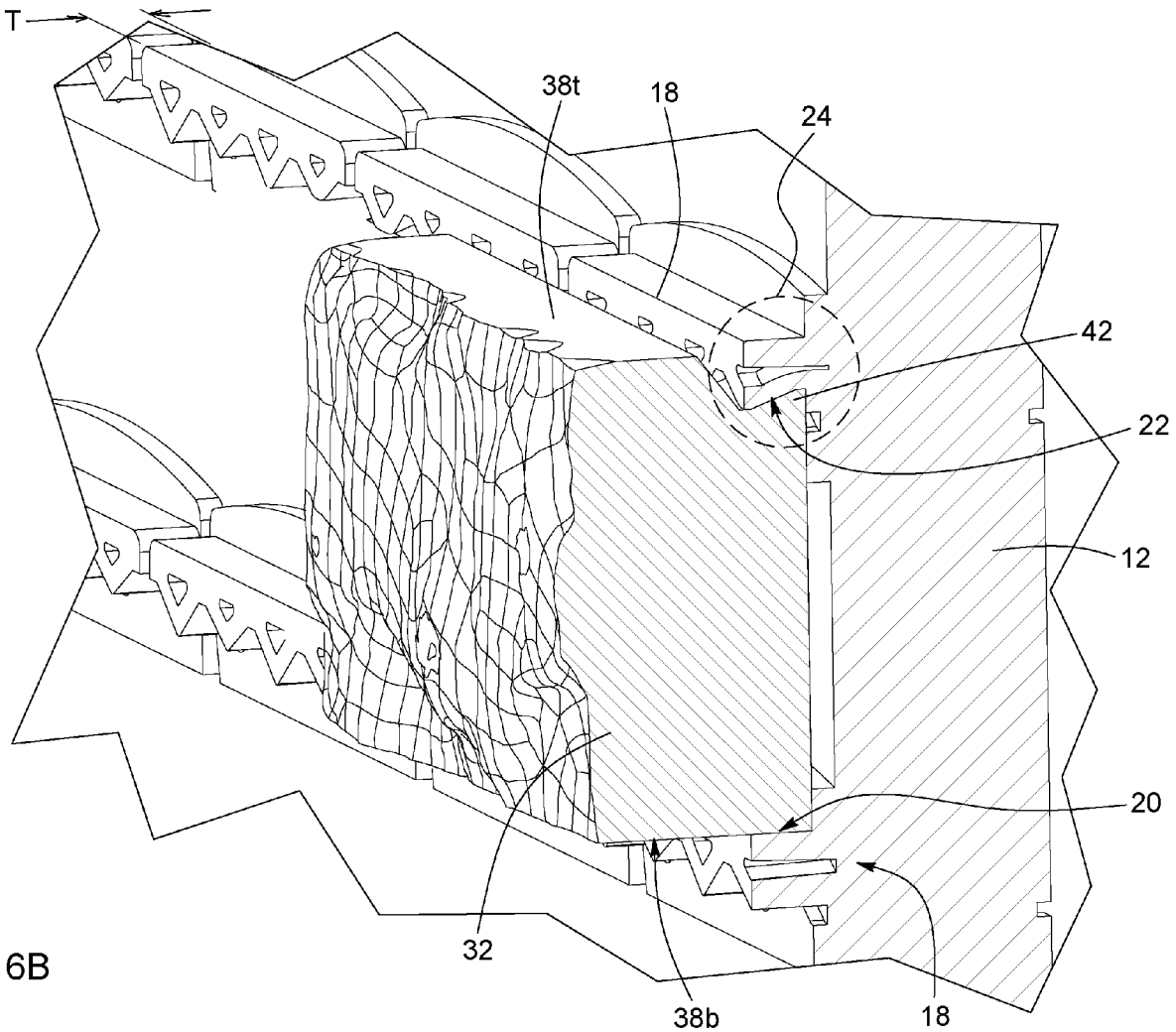
FIG. 6B is a partial cross-sectional view of the panel of FIG. 1 with the unit of FIG. 6 inserted between two horizontal ribs.

Referring to FIGS. 6 and 6A, the masonry units 32 can be provided with a tooth which is indented or recessed from the top lateral face, rather than projecting from it. The recessed tooth 42 will compress the projections when in place in the panel, as best shown in FIG. 6B. Still referring to FIG. 6B, this variant of the unit advantageously allows the top surface 38*t* of the unit to extend frontward and slightly above the ribs, which allows creating narrower joints between adjacent rows of units.

Now with reference to FIGS. 3 and 5, the insertion procedure of a unit 32 into a panel 12 will be described. When inserting a unit 32 between two opposed horizontal ribs 18, the tooth or teeth 42 of the unit is/are first thrust into the bottom side 22 of the ribs 18, underneath a top horizontal rib 18. Each tooth 42 bites into the compressible rib 18 and projections 24, thus helping to retain the unit 32 in the panel 12. As explained earlier, the ribs 18 are compressible and preferably made of polystyrene. The unit 32 is then tilted or pivoted about its top peripheral edge 40 downwardly, so as to insert the rest of the unit into the panel 12. The bottom lateral face 38*b* of the unit 32 can then rest against the top side 20 of a bottom horizontal rib 18. The spacers 44 of the unit 32 fit between the gap or recess between two adjacent projections 24. When inserted between two horizontal ribs 18, the masonry unit 32 has a natural tendency to fall out of the panel by rotating about the bottom horizontal rib 18, but this tendency is countered by the engagement between the tooth 42 with the projections 24, which prevents the masonry unit 32 from falling out of the panel 12. As it can be appreciated, the cavity 28 in each projection 24 provides it with more flexibility, and the projection 24 is more likely to elastically deform, without rupturing, even if the unit 32 inserted between the ribs 18 is slightly higher than the standard size. The cavity in the projection also allows inserting the unit without deforming the top surface of the rib. The insertion procedure for units with a recessed tooth is similar as for a unit with a projecting tooth, except that the top portion of the unit covers partially the top rib once in place in the panel (as shown in FIG. 6B).

Figure 9B:
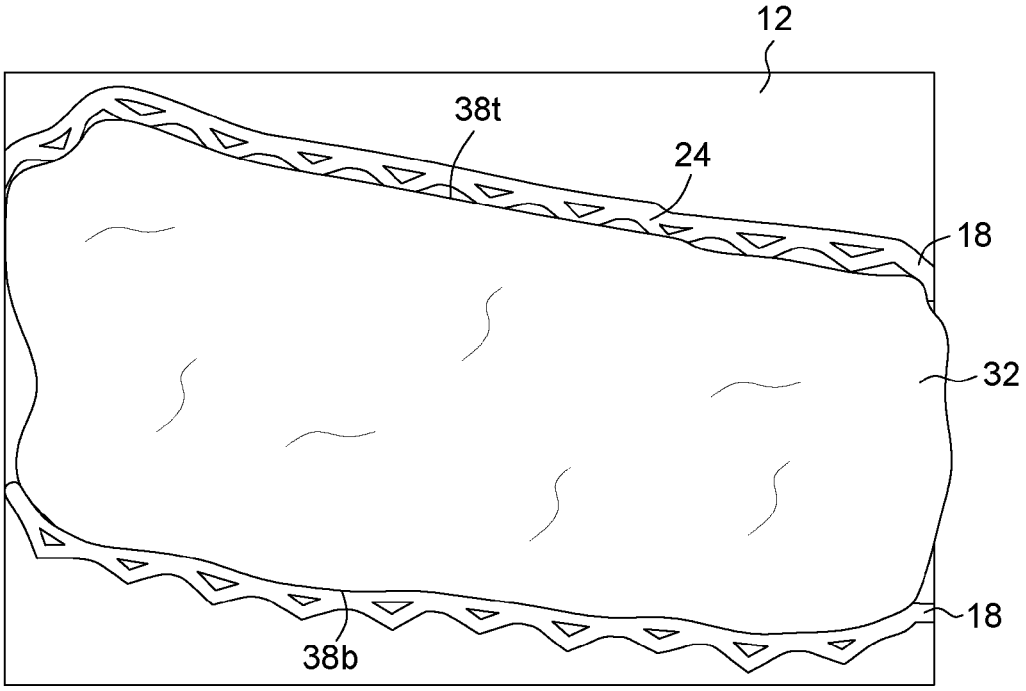
FIG. 9B is a partial front view of the panel of FIG. 9A, with a masonry unit inserted between opposed rows of ribs.

FIGS. 9A and 9B shown yet another possible embodiment of a panel 12 and a masonry unit 32. In this case the ribs are still longitudinal and they extend slightly at angle on the front face 16 of the panel. The unit 32 has opposed top and lateral faces 38*t*, 38*b*, cooperating with top and bottom ribs 18. A tooth (not shown in the figure) on the top face 38*t* thrusts into the resilient projections 24 and compresses them to retain the unit within the opposed ribs 18.

Figure 10:
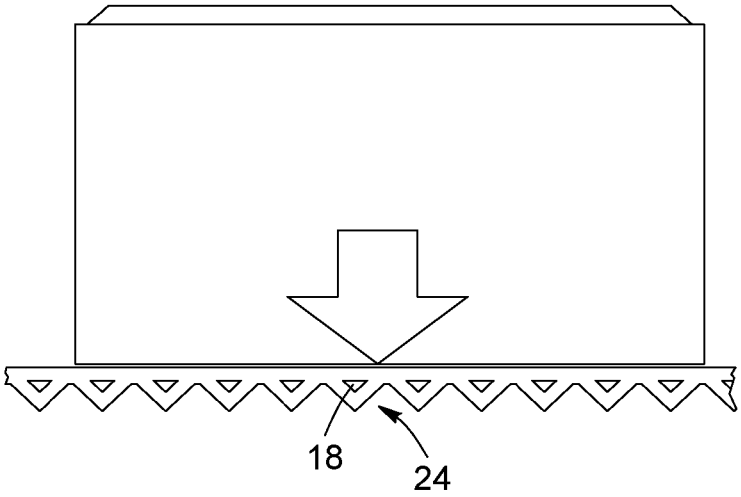
FIG. 10 is a schematic view of a masonry unit resting on a horizontal rib provided with triangular projections, according to an embodiment.
Figure 10A:
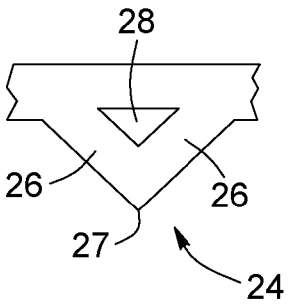
FIGS. 10A-10C are schematic views of various possible shapes for a projection of the horizontal rib of FIG. 10.
Figure 10B:
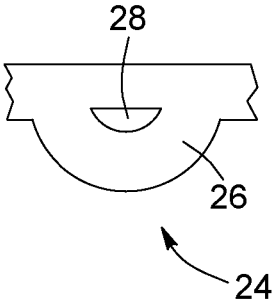
Figure 10C:
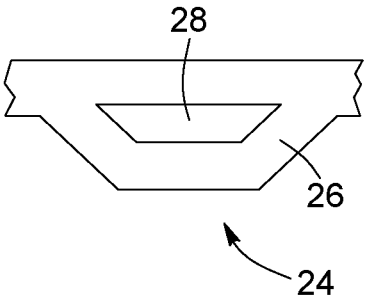
Figure 11:
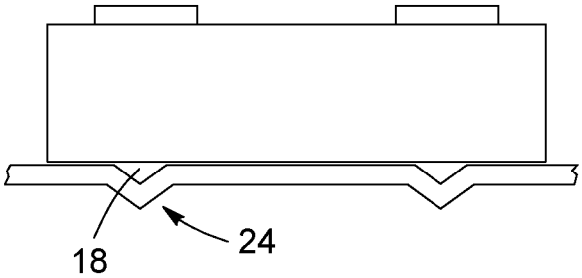
FIG. 11 is a schematic view of a masonry unit resting on a horizontal rib provided with V-shape projections, according to another embodiment.
Figure 11A:
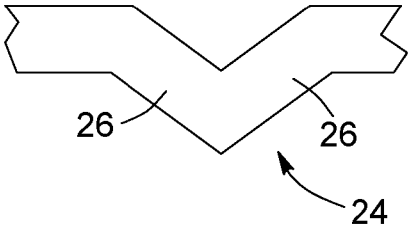
FIG. 11A is an enlarged schematic view of one the V-shape projections of FIG. 11.

FIGS. 10-11A schematically shows some of the many possible different embodiments of a projection 24. In FIGS. 10 and 10A, the projections 24 are triangular projections 24, the compressible lower segment 26 delimiting the cavity 28, and structurally reinforcing the rib 18. In FIG. 10B, the projection 24 is a semi-circular projection 24, where the compressible lower segment 26 delimiting the cavity 28. In FIG. 100, the projection 24 is trapezoidal, the compressible lower segment 26 delimiting part of the cavity 28. In FIGS. 11 and 11A, the projections 24 also have a triangular shape, defining a void 18 in the rib 18. In such a configuration, the projections 24 provide resiliency to the rib 18.

Figure 12:
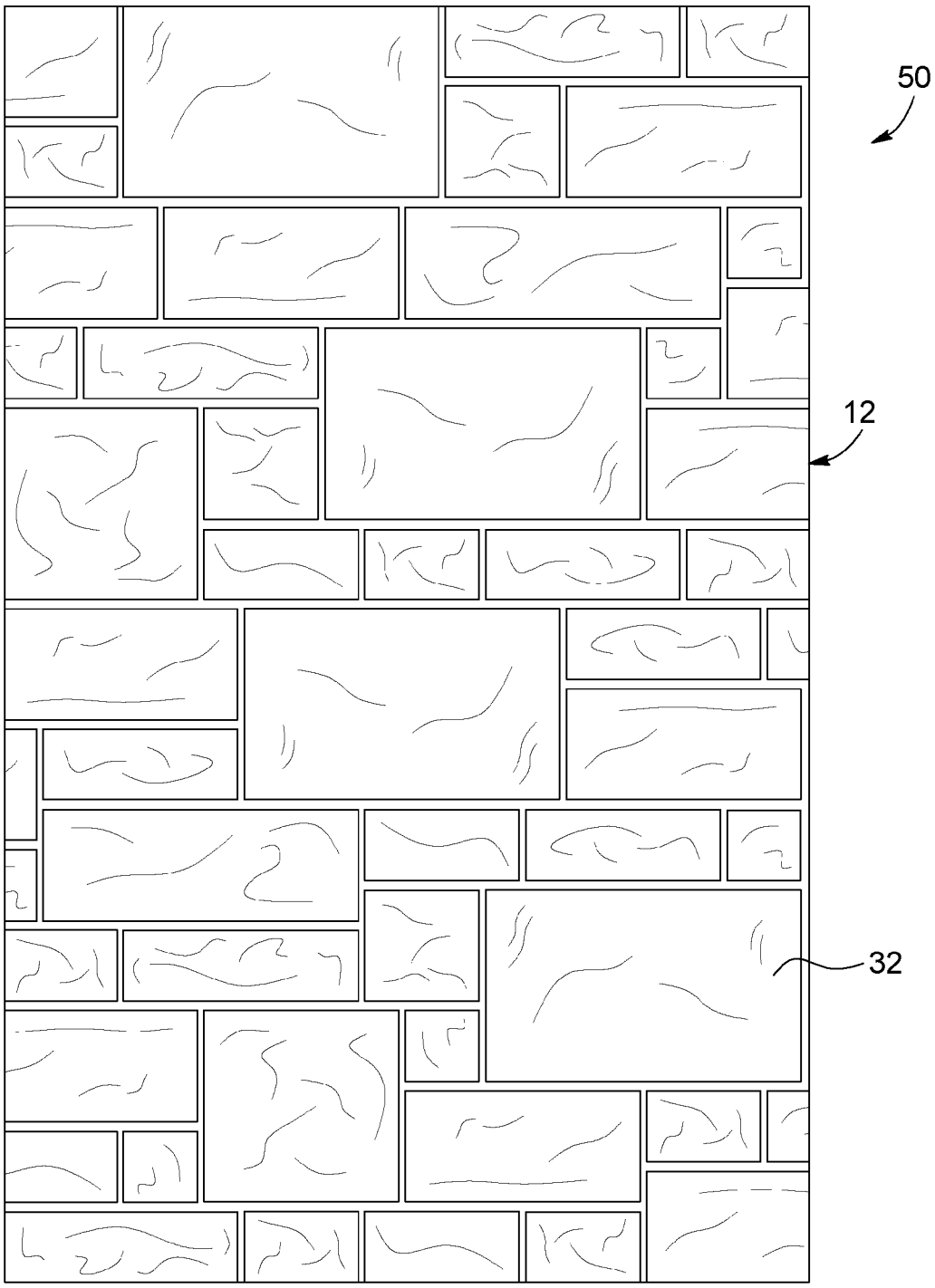
FIG. 12 is a partial front view of a masonry wall, according to an embodiment.
Figure 13:
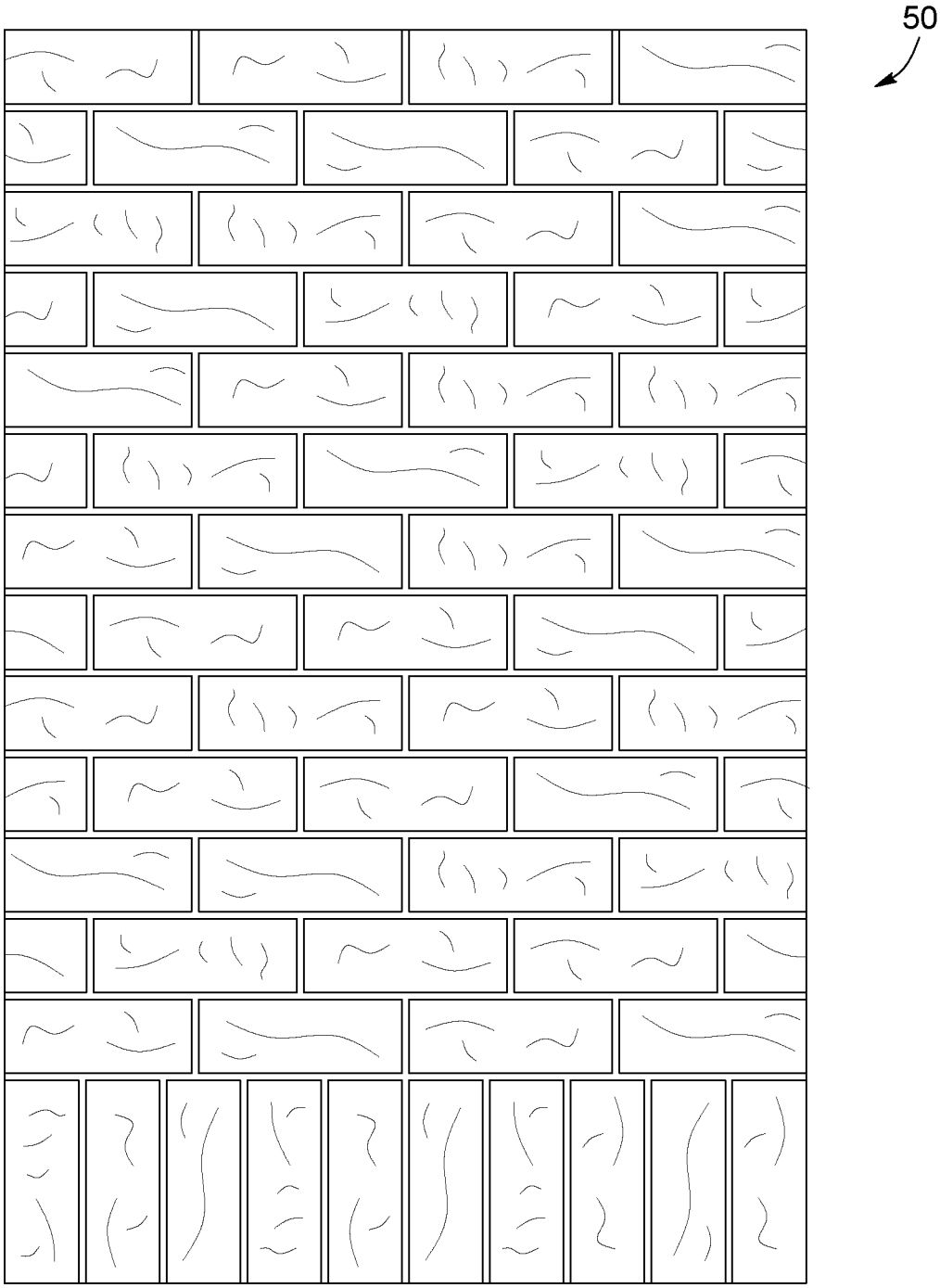
FIG. 13 is a partial front view of a masonry wall, according to another embodiment.

Referring now to FIGS. 12 and 13, different masonry wall systems 50 are shown. The panel 12 and artificial masonry units 32 form together the masonry wall system 50, which can be used for covering a building surface, such as for making a brickwork or stonework.

As it can be appreciated, the masonry wall system 50 described above allows building a masonry wall covering a building surface. The wall comprises one or more panels 12 as described above, mounted side by side on the building surface, each one of the panels comprising a back face covering the building surface, and a front face provided with the horizontal ribs. Masonry units as described above are inserted between adjacent horizontal ribs. The masonry wall can also include mortar binding the masonry units and the panel together.

There is also provided a method for making a masonry wall, so as to cover a building surface, for example. The method includes the steps of:

a) providing a masonry wall system such as the one described above;
b) mounting side by side, on the building surface, a plurality of the at least one panel and fastening the panels to the building surface with retaining anchor screws;
c) inserting, between at least two opposed horizontal ribs, one of the masonry units and retaining said masonry unit by compressing the projections and deforming the corresponding cavities;
d) repeating step c) with all of said masonry units; and
e) mortaring the masonry units and the retaining anchor screws.

As it can be appreciated, the panel and masonry units described above offer several advantages over prior art masonry wall systems.

More particularly, the presence of an empty space or a cavity within each of the projections of the panel allows for the retention of masonry units even when their height differs from their "ideal", or standard height. This deviation in masonry units becomes more common with time, as the molds used for forming the units tend to wear. This leads to the overall dimension of the units manufactured tending to increase. Since the units are dimensioned so as to fit tightly in the panel, it becomes difficult to insert a unit in between two ribs of the panel when the unit is bigger than its nominal or standard dimension. Projections with cavities can be compressed to a greater extent than full, non-empty, and especially squared projections, the degree of compression increasing by up to 100% in some instances. In other words, while a full square projection can generally be compressed by X mm, a projection having the same height and provided with a void or cavity may be able to be compressed by up to 2X mm. Consequently, units with a height slightly different than the standard height can still fit between two ribs. By "slightly different", it is meant a unit having a height which differs from the standard height by a height variation D. In some embodiments, the height variations is less than about 5 mm, and can further vary from +/−3 to +/−5 mm from the standard height. As previously explained, each projection can be compressed a vertical distance by a masonry unit. This vertical distance may correspond at least to the height variation of the masonry unit.

In addition, the present masonry wall system allows several units to be handled and "clamped" during the manufacturing process. The operation known as "clamping" consists of assembling the various masonry units into a board-like formation for facilitating their packaging. For units with projecting teeth, the units can be provided with spacers facilitating their clamping. Masonry units with projecting teeth which are not provided with spacers are difficult to mechanically clamp because they pile-up when they are pushed together, which necessitates time-consuming and costly manual clamping. Masonry units with projecting tooth/teeth advantageously contain spacers which prevent pile-up when the units are mechanically clamped.

For units with recessed or indented teeth, the top face of the unit is flat, which allows clamping of the units without having to form spacers on their top face.

Although preferred embodiments of the present invention have been described in detail herein and illustrated in the accompanying drawings, it is to be understood that the invention is not limited to these precise embodiments and that various changes and modifications may be effected therein without departing from the present invention.

The invention claimed is:

1. A masonry wall system comprising a panel for receiving masonry units, each masonry unit comprising a body having a front face, a back face, and top and bottom lateral faces, the back face and top lateral face forming a back peripheral edge, the top lateral face being provided with at least one tooth extending at the back peripheral edge, the panel comprising:

a back face for covering a building surface, a front face provided with opposed ribs, each rib having top and bottom sides, the opposed ribs configured for receiving masonry units there between, the top sides of the ribs configured for supporting the bottom lateral faces of the masonry units, the bottom sides of the ribs comprising a plurality of projections, each projection having a lower segment and a top segment separated by a cavity that extends through a thickness of the projection, wherein, when masonry units having a first vertical dimension are inserted between opposed ribs, the lower segment of each projection is distorted a first amount by the at least one tooth and is distorted a second amount by the top lateral face itself, wherein the first amount of distortion is greater than the second amount of distortion, and wherein both distortions compress the cavity of each projection but do not distort the top segment of each projection.

2. The masonry wall system according to claim 1, wherein the lower segment comprises a projection tip that is defined by two lower portions of the lower segment.

3. The masonry wall system according to claim 1, wherein the lower segment has an outer contour slope different than 0.

4. The masonry wall system according to claim 2, wherein the two lower portions are angled to meet at a point that forms the projection tip.

5. The masonry wall system according to claim 1, wherein the top segment comprises a flat upper surface.

6. The masonry wall system according to claim 1, wherein the cavity is open on an exposed side of the rib.

7. The masonry wall system according to claim 1, wherein for each projection, the cavity has a shape that corresponds to a shape of the projection.

8. The masonry wall system according to claim 1, wherein each projection has a height that spans from an upper surface of the top segment to a lower surface of the lower segment.

9. The masonry wall system according to claim 8, wherein the lower surface of the lower segment is narrower than the upper surface of the top segment.

10. The masonry wall system according to claim 1, wherein at least some of the projections are semi-circular.

11. The masonry wall system according to claim 1, wherein at least some of the projections are triangular.

12. The masonry wall system according to claim 1, wherein the opposed ribs are parallel and extend horizontally along the front face of the panel.

13. The masonry wall system according to claim 1, wherein the projections include at least two different sets of projections, the projections within each set having a same height, and wherein the height of the projections within one set is different from the height of the projections within a second set.

14. The masonry wall system according to claim 13, wherein the at least two different sets of projections include a first set of projections having a first height H1 and a second set of projections having a second height H2, the first height H1 being greater than the second height H2, wherein, when masonry units having the first vertical dimension are inserted between opposed ribs, the projections having the first height H1 are distorted the first amount by the at least one tooth and are distorted the second amount by the top lateral face itself, wherein, when masonry units having a second vertical dimension are inserted between opposed ribs, the projections having the second height H2 are distorted the first amount by the at least one tooth, and are distorted the second amount by the top lateral face itself, and wherein the first vertical dimension is smaller than the second vertical dimension.

15. The masonry wall system according to claim 14, wherein the projections of the first set are alternated with the projections of the second set.

16. The masonry wall system according to claim 12, wherein at least one of the horizontal ribs includes several rib sections, each rib section creating a through opening in the horizontal rib, thereby allowing water to flow towards the bottom of the panel.

17. The masonry wall system according to claim 1, wherein the masonry units are inserted into depressions located between opposed ribs, wherein each depression is bordered by two of the opposed ribs, and by two vertical ribs.

18. The masonry wall system according to claim 17, wherein the depressions are of various dimensions and configured to receive masonry units of different standard sizes.

19. The masonry wall system according to claim 1, wherein the panel is made of polystyrene, foam or a compressible material.

20. The masonry wall system according to claim 1, wherein some of the masonry units have a height that differs from the first vertical dimension by a variation D.

21. The masonry wall system according to claim 20, wherein the variation D is less than 5 mm.

22. The masonry wall system according to claim 1, wherein for each of the masonry units, the at least one tooth projects upwardly on the top lateral face, from the back peripheral edge.

23. The masonry wall system according to claim 1, wherein for each of the masonry units, the at least one tooth is recessed from said top lateral face, at the back peripheral edge.

24. The masonry wall system according to claim 22, wherein for each of the masonry units, the at least one tooth extends continuously along the back peripheral edge.

25. The masonry wall system according to claim 22, wherein each of the masonry units comprise spacers for facilitating the handling of several of the masonry units in a single handling operation, each of the spacers being positioned and sized so as to fit between two projections when the masonry units are inserted between opposed ribs.

26. The masonry wall system according to claim 22, wherein each of the masonry units comprise spacers for facilitating the handling of several of the masonry units in a single handling operation, each of the spacers being positioned and sized so as be located forward of the projections when the masonry units are inserted between opposed ribs.

27. A method for making a masonry wall, the method comprising the steps of:

a) providing a masonry wall system as defined in claim 1;

b) mounting side by side, on the building surface, a plurality of the panels and fastening the panels to the building surface with retaining anchor screws;

c) inserting, between at least two opposed ribs, one of the masonry units and retaining the masonry unit by distorting each projection by the first amount with the at least one tooth, and distorting each projection by the second amount by the top lateral face of the masonry unit;

d) repeating step c) with all of the masonry units; and e) mortaring the masonry units and the retaining anchor screws.

28. A masonry wall system for covering a building surface, comprising:

a plurality of masonry units, each masonry unit comprising a body having a front face, a back face, and lateral faces including top and bottom lateral faces, the lateral faces providing a thickness to the masonry unit, the back face and top lateral face forming a back peripheral edge, the top lateral face being provided with at least one tooth recessed or projecting from the back peripheral edge, at least one wall panel for receiving the masonry units, the at least one wall panel comprising:

a back face for covering the building surface, a front face provided with opposed longitudinal ribs, each rib having top and bottom sides, the opposed ribs configured for receiving masonry units there between, the top sides of the ribs configured for supporting the bottom lateral faces of the masonry units, the bottom sides of the longitudinal ribs comprising a plurality of projections, each projection having a lower segment and a top segment with a flat upper surface separated by a cavity that extends through a thickness of the projection, the projections including at least two sets of projections, each set having projections of the same height within the set, the first set having a first height H1 and the second set having a second height H2, the first height H1 being greater than the second height H2, wherein, when masonry units having a first vertical dimension are inserted between opposed ribs, the lower segment of each projection in the first set is distorted a first amount by the at least one tooth and is distorted a second amount by the top lateral face itself, wherein, when masonry units having a second vertical dimension are inserted between opposed ribs, the lower segment of each projection in the second set is distorted the first amount by the at least one tooth and is distorted the second amount by the top lateral face itself, wherein the first vertical dimension is smaller than the second vertical dimension, wherein the first amount of distortion is greater than the second amount of distortion, and wherein both distortions compress the cavity of each projection but do not distort the top segment of each projection.

* * * * *